US009448008B2

(12) United States Patent
Lee et al.

(10) Patent No.: US 9,448,008 B2
(45) Date of Patent: Sep. 20, 2016

(54) AIR CONDITIONER AND CONTROL METHOD THEREOF

(71) Applicant: SAMSUNG ELECTRONICS CO., LTD., Suwon-si, Gyeonggi-do (KR)

(72) Inventors: Ji Eun Lee, Seongnam-si (KR); Su Ho Jo, Seongnam-si (KR); Kwan Joo Myoung, Suwon-si (KR); Awata Hiroshi, Seongnam-si (KR); Yuodo, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 287 days.

(21) Appl. No.: 14/163,295

(22) Filed: Jan. 24, 2014

(65) Prior Publication Data

US 2015/0000310 A1 Jan. 1, 2015

(30) Foreign Application Priority Data

Jun. 28, 2013 (KR) ..... 10-2013-0075597

(51) Int. Cl.

| | |
|---|---|
| ***F25D 3/12*** | (2006.01) |
| ***F25D 29/00*** | (2006.01) |
| ***F25B 49/02*** | (2006.01) |
| *F25B 13/00* | (2006.01) |

(52) U.S. Cl.

CPC ..... *F25D 29/00* (2013.01); *F25B 49/02* (2013.01); *F25B 13/00* (2013.01); *F25B 2313/007* (2013.01); *F25B 2313/0231* (2013.01); *F25B 2600/07* (2013.01)

(58) Field of Classification Search

CPC ..... F24F 13/20; F24F 1/02; F24F 1/0007; F25D 3/122

USPC ..... 62/56, 126, 228.1, 259.1

See application file for complete search history.

(56) References Cited

U.S. PATENT DOCUMENTS

| | | | | |
|---|---|---|---|---|
| 2009/0077990 A1* | 3/2009 | Nakajima | ..... | F24F 1/0003 62/259.1 |
| 2012/0033745 A1* | 2/2012 | Jo | ..... | F24F 11/006 375/257 |

* cited by examiner

*Primary Examiner* — Melvin Jones

(74) *Attorney, Agent, or Firm* — Staas & Halsey LLP

(57) ABSTRACT

An air conditioner is provided. The air conditioner includes at least one outdoor unit, a plurality of indoor units, and at least one remote controller to receive operation commands for the plural indoor units. One of the plural indoor units may be selected as a power-supplying indoor unit to supply electric power to the at least one remote controller, based on voltage values of electric power to be supplied from the plural indoor units to the at least one remote controller. The selected indoor unit supplies electric power to the at least one controller. The air conditioner enables a supply of electric power with a sufficiently high voltage to a remote controller by supplying electric power to the remote controller by one indoor unit exhibiting a highest voltage value of electric power to be supplied to the remote controller, as compared to other indoor units.

19 Claims, 16 Drawing Sheets

FIG. 9D

SUPPLY VOLTAGE TABLE (VT)

| ADDRESS | VOLTAGE VALUE |
|---|---|
| 003 | 11.9V |
| 004 | 11.8V |
| 005 | 11.6V |
| ⋮ | ⋮ |
| 012 | 10.0V |

AIR CONDITIONER AND CONTROL METHOD THEREOF

CROSS-REFERENCE TO RELATED APPLICATIONS

This application is related to, and claims priority to, Korean Patent Application No. 10-2013-0075597 filed on Jun. 28, 2013 in the Korean Intellectual Property Office, the disclosure of which is incorporated herein by reference.

BACKGROUND

1. Field

Embodiments of the present invention relate to an air conditioner including a remote controller and a control method thereof.

2. Description of the Related Art

A multi-type air conditioner, which is an air conditioning system, includes one or more outdoor units and one or more indoor units, to execute centrally-controlled air conditioning for the entirety of a building or one story of the building.

Such a multi-type air conditioner generally includes one or more remote controllers (e.g., wired remote controllers) in order to input operation commands for two or more indoor units. For example, in a multi-type air conditioner including five (5) indoor units for each story of a 10-story building, one remote controller is provided to each floor, to collectively input an operation command for the five (5) indoor units on the floor.

In this case, generally, the remote controller does not directly receive external electric power such as commercial electric power, but receives electric power from one of the indoor units connected to the remote controller.

The indoor unit to supply electric power to the remote controller may be randomly set. For example, the indoor unit assigned a lowest address value or the indoor unit assigned a highest address value is set to supply electric power to the remote controller.

However, when the distance between the remote controller and the indoor unit to supply electric power to the remote controller is very long, it may be difficult to supply electric power with a sufficiently high voltage to the remote controller due to voltage drop occurring at a power line to connect the remote controller to the indoor unit.

SUMMARY

It is an aspect of the present invention to provide a multi-type air conditioner that includes a remote controller, and is configured to supply electric power with a sufficiently high voltage to the remote controller.

Additional aspects of the invention will be set forth in part in the description which follows and, in part, will be obvious from the description, or may be learned by practice of the invention.

In accordance with an aspect of the present invention, an air conditioner includes at least one outdoor unit to execute heat exchange operation for heat exchange between outdoor air and refrigerant, a plurality of indoor units to execute heat exchange operation for heat exchange between indoor air and the refrigerant, and at least one remote controller to receive operation commands for the plural indoor units, wherein one of the plural indoor units may be selected as a power-supplying indoor unit to supply electric power to the at least one remote controller, based on voltage values of electric power to be supplied from the plural indoor units to the at least one remote controller, and the selected indoor unit supplies electric power to the at least one controller.

The power-supplying indoor unit may supply electric power to the at least one remote controller via a communication line, through which communications between the plural indoor units and the at least one remote controller are executed.

The communication line may transmit DC power supplied from the power-supplying indoor unit to the at least one remote controller while transmitting high-frequency communication signals from the plural indoor units or from the at least one remote controller.

The remote controller may include a remote-controller power supply module to receive the DC power supplied from the power-supplying indoor unit via the communication line, and a remote-controller power filter to block the high-frequency communication signals.

Each of the plural indoor units may include an indoor-unit power supply module to supply the DC power to the remote controller via the communication line, and an indoor-unit power filter to block the high-frequency communication signals.

When the plural indoor units supply electric power to the at least one remote controller in accordance with a predetermined sequence, the at least one remote controller may detect voltage values of the electric power supplied from the plural indoor units.

The plural indoor units may supply electric power to the at least one remote controller in accordance with a predetermined sequence based on addresses of the plural indoor units.

Each of the plural indoor unit may determine whether another one of the plural indoor unit supplies electric power to the at least one remote controller, and may supply electric power to the at least one remote controller when it is determined that there is no indoor unit supplying electric power to the at least one remote controller.

Each of the plural indoor unit may determine whether over-current flows through the communication line, and may supply electric power to the at least one remote controller when it is determined that no over-current flows through the communication line.

The power-supplying indoor unit may be selected from among the plural indoor units, based on the voltage values detected by the at least one remote controller.

When the at least one remote controller includes a single remote controller, one of the plural indoor units, which supplies electric power with a highest voltage value detected by the single remote controller, may be selected as the power-supplying indoor unit from among the plural indoor units.

When the at least one remote controller includes at least two remote controllers, one of the plural indoor units, which supplies electric power with a highest average of voltage values detected by the at least two remote controllers, may be selected as the power-supplying indoor unit from among the plural indoor units.

In accordance with an aspect of the present invention, a method for controlling an air conditioner including at least one outdoor unit to execute heat exchange operation for heat exchange between outdoor air and refrigerant, a plurality of indoor units to execute heat exchange operation for heat exchange between indoor air and the refrigerant, and at least one remote controller to receive operation commands for the plural indoor units, includes supplying electric power to the at least one remote controller by each of the plural indoor units, detecting voltage values of the electric power respectively supplied from the plural indoor units by the at least one remote controller, and selecting a power-supplying indoor unit to supply electric power to the at least one remote controller, based on the detected voltage values, by the at least one remote controller.

The power-supplying indoor unit may supply electric power to the at least one remote controller via a communication line, through which communications between the plural indoor units and the at least one remote controller are executed.

The communication line may transmit DC power supplied from the power-supplying indoor unit to the at least one remote controller while transmitting high-frequency communication signals from the plural indoor units or from the at least one remote controller.

The supplying electric power to the at least one remote controller by each of the plural indoor units may include supplying electric power to the at least one remote controller by the plural indoor units in accordance with a predetermined sequence based on addresses of the plural indoor units.

The supplying electric power to the at least one remote controller by each of the plural indoor units may further include, by each of the plural indoor unit, determining whether another one of the plural indoor unit supplies electric power to the at least one remote controller, and supplying, and supplying electric power to the at least one remote controller when it is determined that there is no indoor unit supplying electric power to the at least one remote controller.

The supplying electric power to the at least one remote controller by each of the plural indoor units may further include, by each of the plural indoor unit, determining whether over-current flows through the communication line, and supplying electric power to the at least one remote controller when it is determined that no over-current flows through the communication line.

When the at least one remote controller includes a single remote controller, the selecting the power-supplying indoor unit may include selecting one of the plural indoor units, which supplies electric power with a highest voltage value detected by the single remote controller, as the power-supplying indoor unit from among the plural indoor units.

When the at least one remote controller includes at least two remote controllers, the selecting the power-supplying indoor unit may include selecting one of the plural indoor units, which supplies electric power with a highest average of voltage values detected by the at least two remote controllers, as the power-supplying indoor unit from among the plural indoor units.

BRIEF DESCRIPTION OF THE DRAWINGS

These and/or other aspects of the invention will become apparent and more readily appreciated from the following description of the embodiments, taken in conjunction with the accompanying drawings of which:

FIGS. 9A to 9D illustrate an exemplary procedure of controlling the air conditioner according to an embodiment to select one indoor unit to supply electric power to the remote controller.

DETAILED DESCRIPTION

Reference will now be made in detail to the exemplary embodiments of the present invention, examples of which are illustrated in the accompanying drawings.

Figure 1:
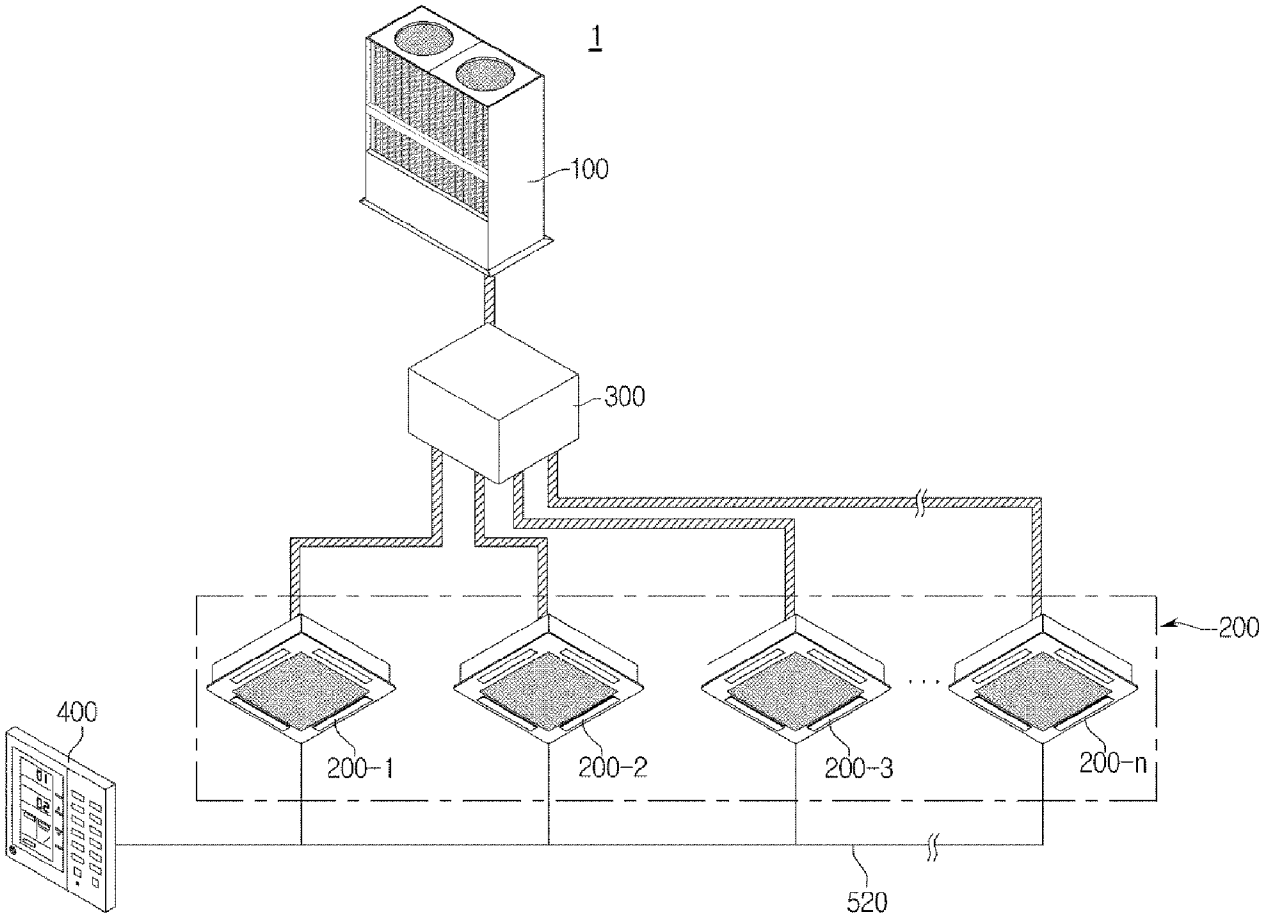
FIG. 1 illustrates an exemplary air conditioner according to an embodiment.

FIG. 1 illustrates an exemplary configuration of an air conditioner according to an embodiment.

Referring to FIG. 1, the air conditioner, which is designated by reference character "1", includes an outdoor unit 100 disposed in an outdoor space, to execute heat exchange operation for heat exchange between outdoor air and refrigerant, and indoor units 200-1, 200-2, 200-3, . . . , and **200-*n* (also, collectively referred to as "200") respectively disposed in indoor spaces, to execute heat exchange operation for heat exchange between indoor air and refrigerant. The air conditioner 1 also includes a distributer 300 to distribute refrigerant supplied from the outdoor unit 100 to the indoor units 200, for selective execution of cooling or heating, and a remote controller 400 to receive an operation command from the user in association with the indoor units 200**.

An exemplary flow of refrigerant and flows of signals in a separate manner such that flow of refrigerant in the air conditioner and flows of signals in an air conditioner are disclosed.

Figure 2:
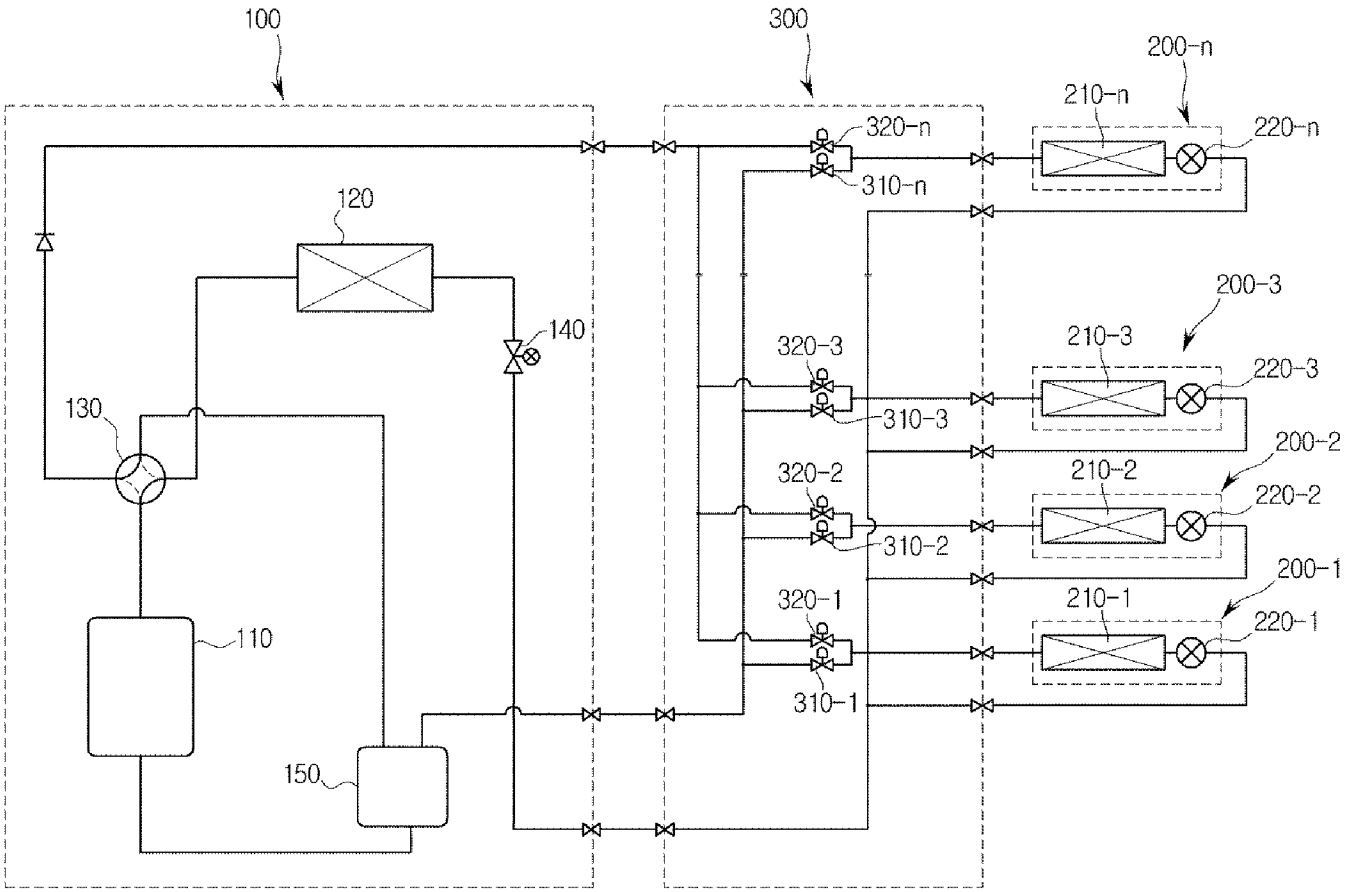
FIG. 2 illustrates exemplary flow of refrigerant in an air conditioner according to an embodiment.

FIG. 2 illustrates an exemplary flow of refrigerant in the air conditioner according to an embodiment.

Referring to FIG. 1 and FIG. 2, the air conditioner 1 includes, as a configuration associated with flow of refrigerant, the outdoor unit 100, the indoor units 200, and the distributer 300.

The outdoor unit 100 includes a compressor 110 to compress gas-phase refrigerant, an outdoor heat exchanger 120 to execute heat exchange operation for heat exchange between outdoor air and refrigerant, and a 4-way valve 130 to selectively guide refrigerant discharged from the compressor 110 to the outdoor heat exchanger 120 or to the indoor units 200. The outdoor unit 100 includes an outdoor expansion valve 140 to reduce pressure of refrigerant guided to the outdoor heat exchanger 120 during heating operation, and an accumulator 150 to prevent liquid-phase refrigerant from being introduced into the compressor 110.

The indoor units 200 include respective indoor heat exchangers 210-1, 210-2, 210-3, . . . , and **210-*n* (also collectively referred to as "210") to execute heat exchange operation for heat exchange between indoor air and refrigerant, and respective indoor expansion valves 220-1, 220-2, 220-3, . . . , and 220-*n* (also collectively referred to as "220") to reduce pressure of refrigerant supplied to respective indoor heat exchanges 210** during cooling operation.

The distributer 300 includes cooling valves 310-1, 310-2, 310-3, . . . , and **310-*n* (also collectively referred to as "310") and heating valves 320-1, 320-2, 320-3, . . . , and 320-*n* (also collectively referred to as "320") arranged between the outdoor unit 100 and the indoor units 200, e.g., between refrigerant lines to guide refrigerant supplied from the outdoor unit 110 to respective indoor units 200, to control flows of refrigerant in accordance with an operation mode of the air conditioner 1**, namely, a cooling mode or a heating mode.

Exemplary circulation of refrigerant is disclosed. An exemplary circulation with one indoor unit 200 is described for simplicity. When the air conditioner 1 is in a cooling mode, refrigerant is compressed to high pressure by the compressor 110 of the outdoor unit 100. The compressed refrigerant may be guided to the outdoor heat exchanger 120 by the 4-way valve 130. The compressed refrigerant may be condensed in the outdoor heat exchanger 120. During condensation, the refrigerant discharges latent heat into outdoor air. The condensed refrigerant is selectively guided to the indoor unit 200 via the distributer 300.

The refrigerant guided to the indoor unit 200 may be pressure-reduced while passing through the indoor expansion valve 220 included in the indoor unit 200, and evaporated in the indoor heat exchanger 210. During evaporation, the refrigerant absorbs latent heat from indoor air. Thus, in the cooling mode, indoor air may be cooled in accordance with heat exchange between refrigerant passing through the indoor heat exchanger 210 and indoor air.

The evaporated refrigerant may be guided to the outdoor unit 100 via the cooling valve 310 included in the distributer 300. In the accumulator 150 of the outdoor unit 100, the refrigerant may be separated into unevaporated liquid-phase refrigerant and evaporated gas-phase refrigerant. The gas-phase refrigerant is then supplied to the compressor 110.

The refrigerant guided to the compressor 110 is compressed, and supplied to the 4-way valve 130 and, as such, the refrigerant circulation is repeated.

In a cooling mode, the air conditioner 1 discharges heat from an indoor space to the outdoors by absorbing heat from indoor air by the indoor unit 200, and discharging the absorbed heat to the outdoors by the outdoor unit 100.

When the air conditioner 1 is in a heating mode, refrigerant is compressed to high pressure by the compressor 110 of the outdoor unit 100. The compressed refrigerant is guided to the distributer 130 by the 4-way valve 130. The refrigerant may be selectively guided from the distributer 200 to the indoor unit 200 via the heating valve 320 of the distributer 300.

The refrigerant is condensed in the indoor heat exchanger 210 included in the indoor unit 200. During condensation, the refrigerant discharges latent heat into indoor air. Thus, in the heating mode, indoor air may be heated in accordance with heat exchange between refrigerant passing through the indoor heat exchanger 210 and indoor air. The condensed refrigerant may be guided to the outdoor unit 100 via the distributer 300 after being pressure-reduced by the indoor expansion valve 220.

The refrigerant guided to the outdoor unit 10 may be pressure-reduced while passing through the outdoor expansion valve 140 included in the outdoor unit 100, and then evaporated in the outdoor heat exchanger 120. In the accumulator 150, the evaporated refrigerant may be separated into unevaporated liquid-phase refrigerant and evaporated gas-phase refrigerant. The gas-phase refrigerant is supplied to the compressor 110. The refrigerant guided to the compressor 110 is compressed, and supplied to the 4-way valve 130 and, as such, the refrigerant circulation is repeated.

In the heating mode, the air conditioner 1 transfers heat from the outdoors to an indoor space by absorbing heat from outdoor air via the outdoor unit 100, and discharging the absorbed heat to the indoor space by the indoor unit 200.

Exemplary flows of signals among configurations in an air conditioner are disclosed. To assist in understanding of flows of signals, the elements of the air conditioner such as the outdoor unit, indoor unit, and distributer will be collectively referred to as "included units" in the following description.

Figure 3:
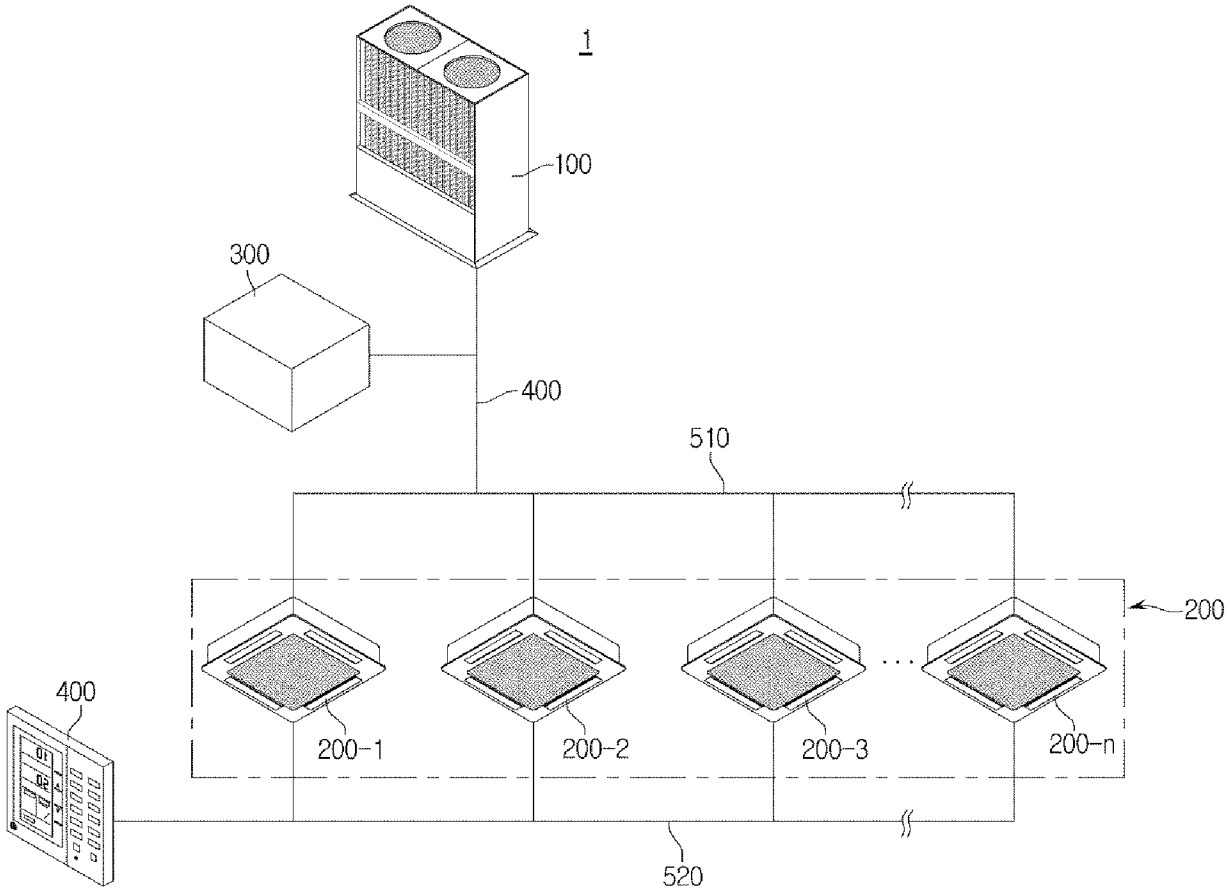
FIG. 3 illustrates exemplary flows of communication signals in the air conditioner according to an embodiment.

FIG. 3 is a view illustrating configurations associated with flows of communication signals in the air conditioner according to an embodiment.

Referring to FIG. 3, the air conditioner 1 includes, in association with flows of signals, the outdoor unit 100, the indoor units 200, the distributer 300, the remote controller 400, and a communication line 510-520 to connect the included units 100, 200, 300, and 400 included in the air conditioner 1.

The included units 100, 200, 300, and 400 included in the air conditioner 1 may be spaced apart from one another by a considerable distance. For example, when one indoor unit 200 is disposed on each floor in a 10-story building with each floor being approximately 2.5 m in height, there is a distance of at least approximately 25 m between the 10th indoor unit 200-10 disposed at the 10th story and the first indoor unit 200-1 disposed at the first story.

Due to distances among the included units 100, 200, 300, and 400, requests and responses among the included units 100, 200, 200, and 400 may be transferred through communications using the communication line 510-520. When the first indoor unit 200-1 disposed at the first story is required to execute a cooling operation for an indoor space at the first story, the first indoor unit 200-1 sends a signal requesting circulation of refrigerant to the outdoor unit 100 via the communication line 510-520. In response to the signal from the first indoor unit 200-1, the outdoor unit 100 sends, to the first indoor unit 200-1 via the communication line 510-520, a signal indicating reception of the request from the first indoor unit 200-1. The outdoor unit 100 operates the compressor 110 (see, for example, FIG. 2), and sends, to the distributer 300 via the communication line 510-520, a signal requesting opening of the cooling valve to supply refrigerant to the first indoor unit 200-1. In response to the signal from the outdoor unit 100, the distributer 300 sends a signal indicating reception of the request from the outdoor unit 100 via the communication line 510-520.

The communication line 510-520 includes a first communication line 510 to connect the outdoor unit, indoor unit 200, and distributer 300, and a second communication line 520 to connect the indoor unit 200 and remote controller 400. The types of a first communication line 510 and a second communication line 520 may be varied in accordance with a protocol applied to the air conditioner 1. For example, when the air conditioner 1 utilizes Recommended Standard-485 (RS-485) protocol for a half duplex communication system in association with communications among the included units 100, 200, 300, and 400, each of the communication lines 510 and 520 may include a pair of communication wires, namely, a plus (+) communication wire and a minus (−) communication wire. When the air conditioner 1 utilizes Recommended Standard-232C (RS-232C) protocol for a full duplex communication system in association with communications among the included units 100, 200, 300, and 400, each of the communication lines 510 and 520 may include three communication wires, namely, a transmitting wire Tx, a receiving wire Rx, and a ground wire Gnd.

An exemplary embodiment of communications in the air conditioner 1 that utilizes the RS-485 communication system is described. Exemplary embodiments are not limited to use of RS-485.

A remote controller 400 does not directly receive electric power from an external power source, but may receive electric power from one of the plural indoor units 200. The second communication line 520, which connects each indoor unit 200 and the remote controller 400, may serve as a path for communication signals between the indoor unit 200 and the remote controller 400, and as a path to supply electric power from the indoor unit 200 to the remote controller 400. In other words, the indoor units 200 transmit and receive high-frequency communication signals to, and from, the remote controller 400 via a pair of communication lines serving as communication paths, and one of the indoor units 200 supplies DC power to the remote controller 400.

Information of requests and responses transmitted through the communication lines 510 and 520 may be transmitted in the form of frames, each of which a header and a data payload. The header area contains the address of the included unit to transmit a data frame, the address of the included unit to receive the data frame, and information associated with data, for example, the kind of the actual data. The contents to be transmitted by the included unit to transmit the data frame are written on the actual data area. Hereinafter, the "data frame" is referred to as "data", for convenience of description.

Figure 4:
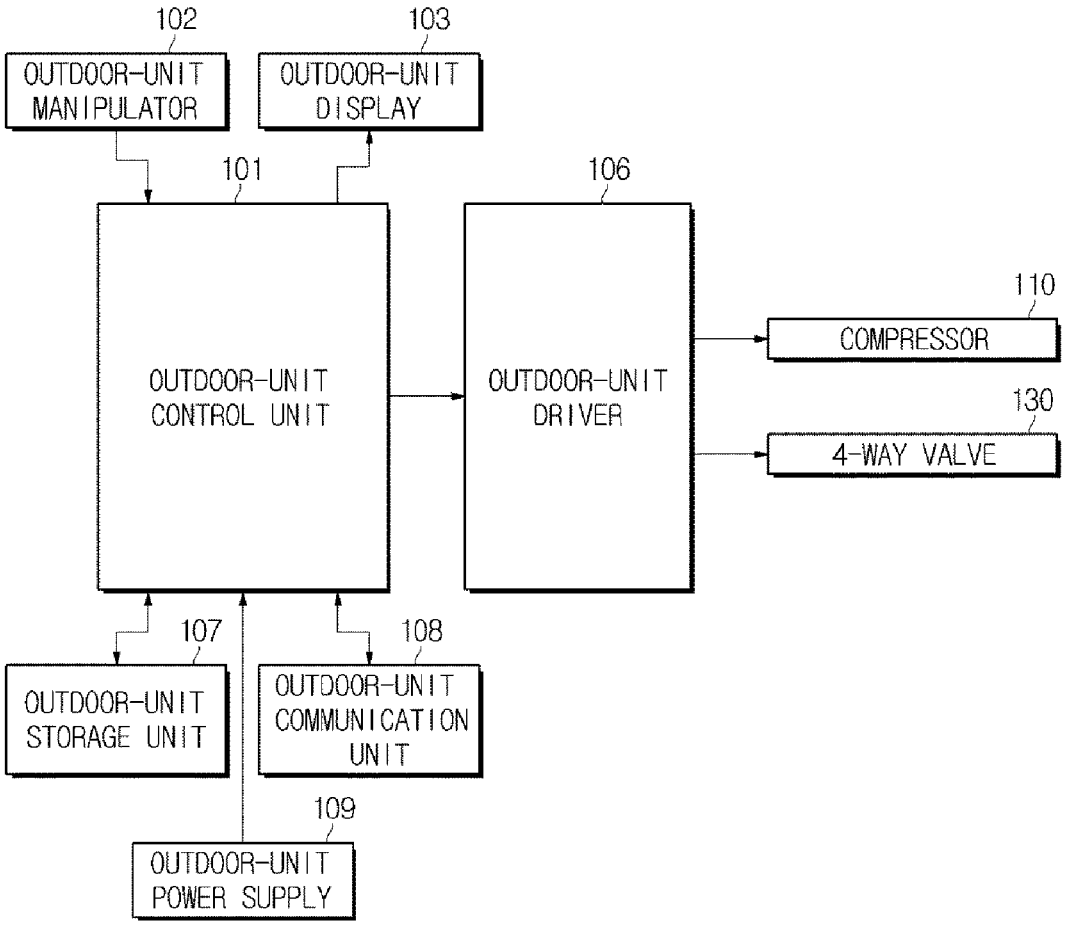
FIG. 4 illustrates exemplary flows of controls signals in an outdoor unit included in the air conditioner according to an embodiment.

FIG. 4 illustrates exemplary flows of controls signals in the outdoor unit included in the air conditioner according to an embodiment.

Referring to FIG. 4, the outdoor unit 100 includes an outdoor-unit manipulator 102 to receive operation commands associated with the outdoor unit 100 or air conditioner 1 from the user or operator, an outdoor-unit display 103 to display operation information of the outdoor unit 100 or air conditioner 1, and an outdoor-unit driver 106 to drive the compressor 110, 4-way valve 130, heating bypass valve 160, and cooling bypass valve 170 included in the outdoor unit 100. The outdoor unit 100 includes an outdoor-unit storage unit 107 to store programs and data associated with operation of the outdoor unit 100, an outdoor-unit communication unit 108 to communicate with the indoor units 200 and distributer 300 included in the air conditioner 1, an outdoor-unit power supply 109 to supply electric power to the included elements of the outdoor unit 100, and an outdoor-unit control unit 101 to control operation of each included element of the outdoor unit 100.

The outdoor-unit manipulator 102 may include button switches, membrane switches, or a touch panel to receive operation commands associated with the outdoor unit 100 or air conditioner 1. The outdoor-unit display 103 may include a liquid crystal display (LCD) panel or a light emitting diode (LED) panel to display operation information of the outdoor unit 100 or air conditioner 1. The outdoor-unit manipulator 102 and outdoor-unit display 103 may be integrated in the form of a touch screen panel (TSP).

The outdoor-unit driver 106 drives the compressor 110, and 4-way valve 130 in accordance with control signals from the outdoor-unit control unit 101. The outdoor-unit driver 106 may include an inverter to supply drive current to a compressor motor (not shown) in order to drive the compressor 110.

The outdoor-unit storage unit 107 may include a non-volatile memory (not shown) such as a magnetic disc or a solid state drive to permanently store programs and data associated with operation of the outdoor unit 100. The outdoor-unit storage unit 107 may include a volatile memory (not shown) such as a D-RAM or an S-RAM to temporarily store temporary data produced during operation of the outdoor unit 100.

The outdoor-unit communication unit 108 may include a communication module (not shown) to execute communication with the indoor units 200 and distributer 300, using a communication system such as an RS-485 communication system.

The outdoor-unit power supply 109 may include a rectifying circuit (not shown) to rectify external electric power, and a smoothing circuit (not shown) to remove ripples from the rectified electric power.

The outdoor-unit control unit 101 controls operation of each included element included in the outdoor unit 100. For example, when the outdoor-unit control unit 101 receives a request for cooling from the third indoor unit 200-3 via the outdoor-unit communication unit 108, the outdoor-unit control unit 101 controls the outdoor-unit communication unit 108, to transmit a cooling request reception signal to the third indoor unit 300-3. The outdoor-unit control unit 101 also controls the outdoor-unit driver 106, to operate the compressor 110. The outdoor-unit control unit 101 controls the communication unit 108, to transmit a signal requesting opening of the third cooling valve 310-3 (see, for example, FIG. 2) to the distributer 300. The outdoor-unit control unit 101 may include a single general processor to execute all arithmetic operations associated with operation of the outdoor unit 100, or a processor to execute specialized arithmetic operations, for example, a communication process to only execute arithmetic operations associated with communications, or a control processor to only execute arithmetic operations associated with control operations.

Figure 5A:
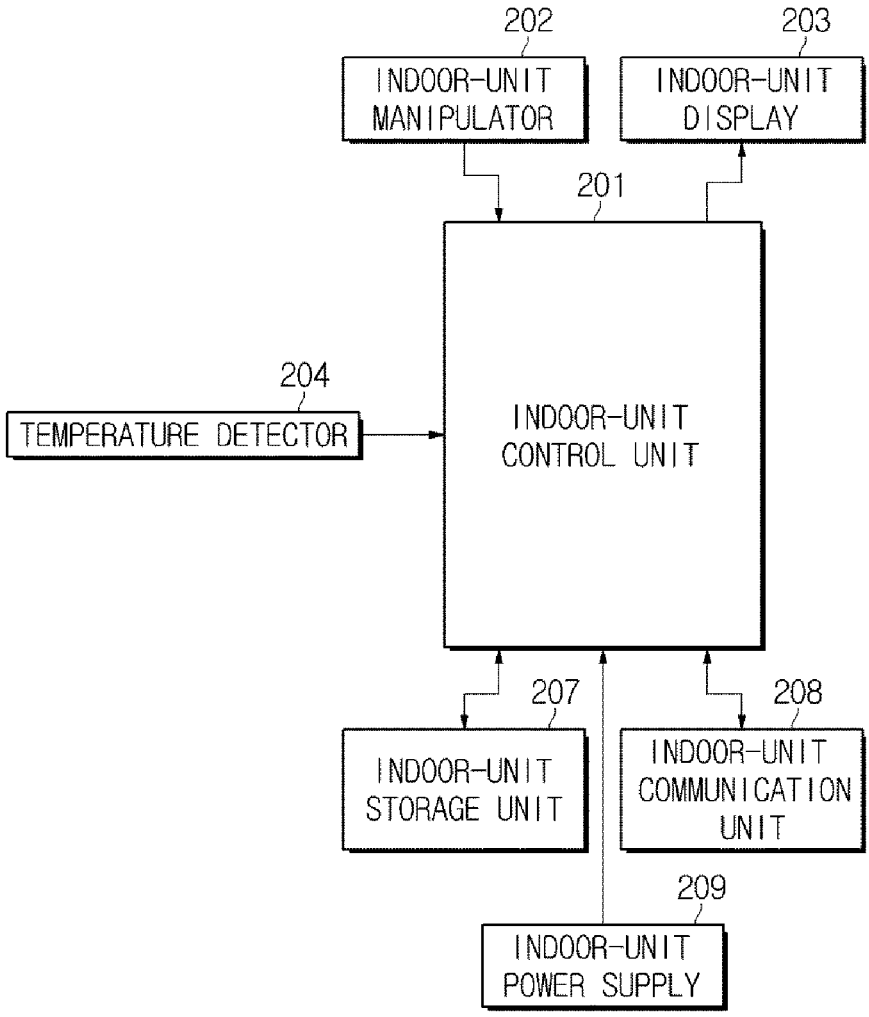
FIG. 5A illustrates exemplary flows of control signals in each indoor unit included in an air conditioner according to an embodiment.
Figure 5B:
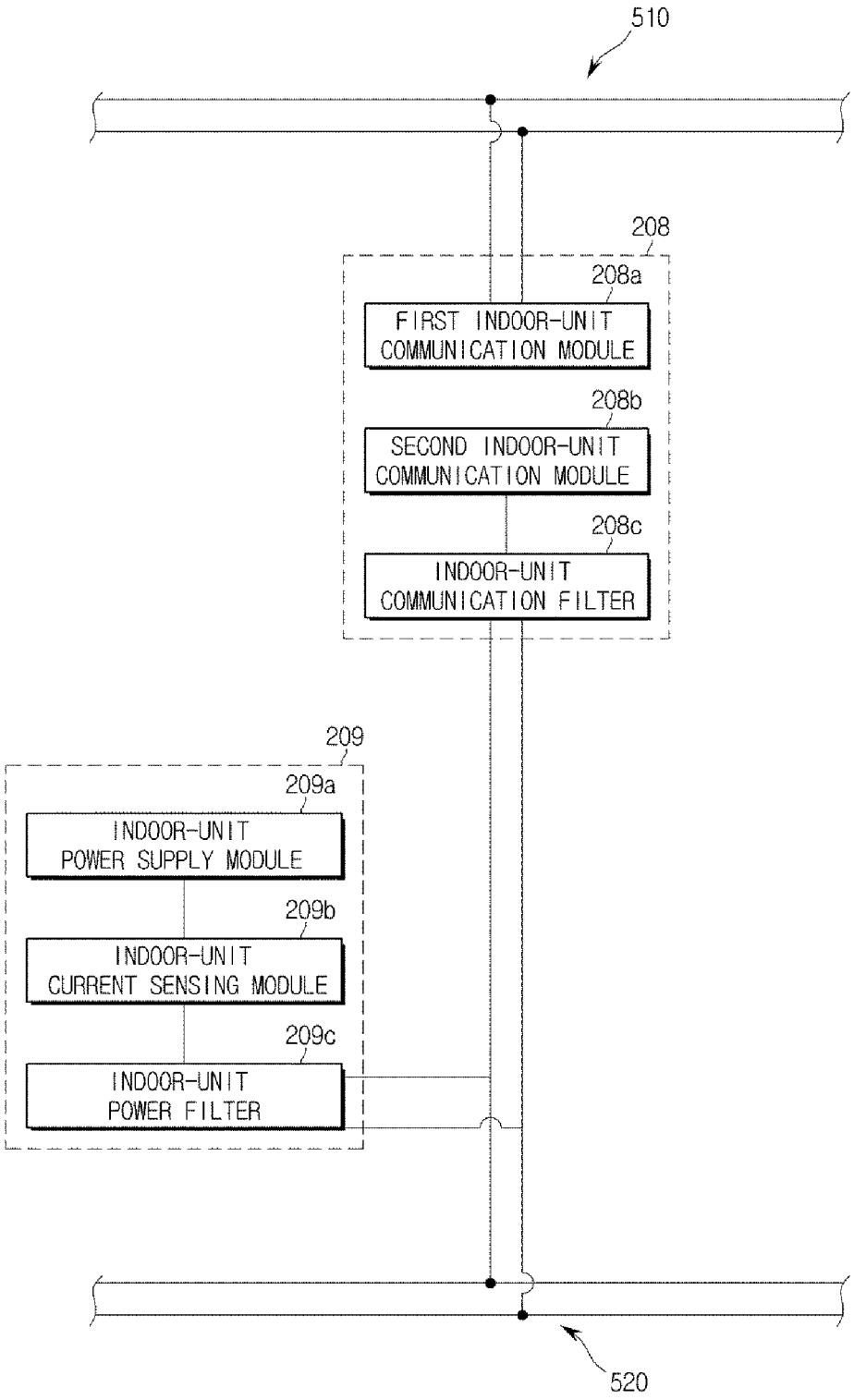
FIG. 5B illustrates an exemplary indoor-unit power supply unit and an indoor-unit communication unit, which are included in the air conditioner according to an embodiment.

FIG. 5A illustrates exemplary flows of control signals in each indoor unit included in the air conditioner according to an embodiment. FIG. 5B illustrates an exemplary indoor-unit power supply unit and an indoor-unit communication unit, which are included in the air conditioner according to an embodiment.

Referring to FIGS. 5A and 5B, each indoor unit 200 includes an indoor-unit manipulator 202 to receive operation commands associated with the indoor unit 200 from the user, an indoor-unit display 203 to display operation information of the indoor unit 200, a temperature detector 204 to detect a temperature of an indoor space where the indoor unit 200 is disposed, and an indoor-unit storage unit 207 to store programs and data associated with operation of the indoor unit 200. The indoor unit 200 includes an indoor-unit communication unit 208 to communicate with another indoor unit 200, the distributer 300, and the remote controller 400, an indoor-unit power supply 209 to supply electric power to the included elements of the indoor unit 200, and an indoor-unit control unit 201 to control operation of each included element of the indoor unit 200.

The indoor-unit manipulator 202 may include button switches, membrane switches, or a touch panel to receive operation commands associated with the indoor unit 200. Since the air conditioner 1 includes the remote controller 400, which receives operation commands associated with the indoor unit 200, and displays operation information of the indoor unit 200, the indoor-unit manipulator 202 of the indoor unit 200 may include only a power button (not shown) to supply electric power required by the indoor unit 200.

The indoor-unit display 203 may include an LCD panel or an LED panel to display operation information of the indoor unit 200. Since the air conditioner 1 includes the remote controller 400, which receives operation commands associated with the indoor unit 200, and displays operation information of the indoor unit 200, the indoor-unit manipulator 202 of the indoor unit 200 may include a power supply display LED (not shown) to display whether electric power required by the indoor unit 200 is supplied and an operation display LED (not shown) to display whether the indoor unit 200 operates.

The temperature detector 204 senses a temperature of the indoor space where the indoor unit 200 is disposed, and outputs an electrical signal corresponding to the sensed temperature. The temperature detector 204 may include a thermistor, which exhibits variation in electrical resistance in accordance with variation in temperature.

The indoor-unit storage unit 207 may include a non-volatile memory (not shown) such as a magnetic disc or a solid state drive to permanently store programs and data associated with operation of the indoor unit 200. The indoor-unit storage unit 207 may include a volatile memory (not shown) such as a D-RAM or an S-RAM to temporarily store temporary data produced during operation of the indoor unit 100.

The indoor-unit communication unit 208 may include a first indoor-unit communication module 208*a* to execute communication with the outdoor unit 100, other indoor units 200, and the distributer 300 via the first communication line 510, using RS-485 communication, and a second indoor-unit communication module 208*b* to execute communication with the remote controller 400 via the second communication line 520. The indoor-unit communication unit 208 also includes an indoor-unit communication filter 208*c* to allow high-frequency communication signals received via the second communication line 520 to pass therethrough while preventing DC power received via the second communication line 520 from passing therethrough.

The second communication line 520 may transmit DC power and high-frequency communication signals in a simultaneous manner. The indoor-unit communication filter 208*c* allows high-frequency communication signals transmitted via the second communication line 520 to pass therethrough while preventing DC power transmitted via the second communication line 520 from passing therethrough. The indoor-unit communication filter 208*c* may include a high-pass filter to allow high-frequency signals to pass therethrough while preventing low-frequency signals from passing therethrough.

The indoor-unit power supply 209 includes an indoor unit power supply module 209*a* to supply electric power to the indoor unit 200 and remote controller 400, an indoor-unit current sensing module 209*b* to sense whether over-current is supplied from the indoor-unit power supply 209 via the second communication line 520, and an indoor-unit power filter 209*c* to block high-frequency communication signals received via the second communication line 520. Since the second communication line 520 transmits DC power and high-frequency communication signals, the indoor-unit power filter 209*c* allows DC power transmitted via the second communication line 520 to pass therethrough while preventing high-frequency communication signals transmitted via the second communication line 520 from passing therethrough. The indoor-unit communication filter 209*c* may include a low-pass filter to allow low-frequency signals to pass therethrough while preventing high-frequency signals from passing therethrough.

The indoor-unit control unit 201 may control operation of each element included in the indoor unit 200. For example, when the temperature detector 204 detects that the indoor temperature is higher than a target cooling temperature, the indoor-unit control unit 201 controls the indoor-unit communication unit 208, to transmit a cooling request signal to the outdoor unit 100. The indoor-unit control unit 201 controls the indoor-unit display 203, to display that the air conditioner 1 is executing a cooling operation. The indoor-unit control unit 201 may include a single general processor to execute arithmetic operations associated with operation of the indoor unit 200, or a processor to execute specialized arithmetic operations, for example, a communication process to only execute arithmetic operations associated with communications, or a control processor to only execute arithmetic operations associated with control operations.

Figure 6:
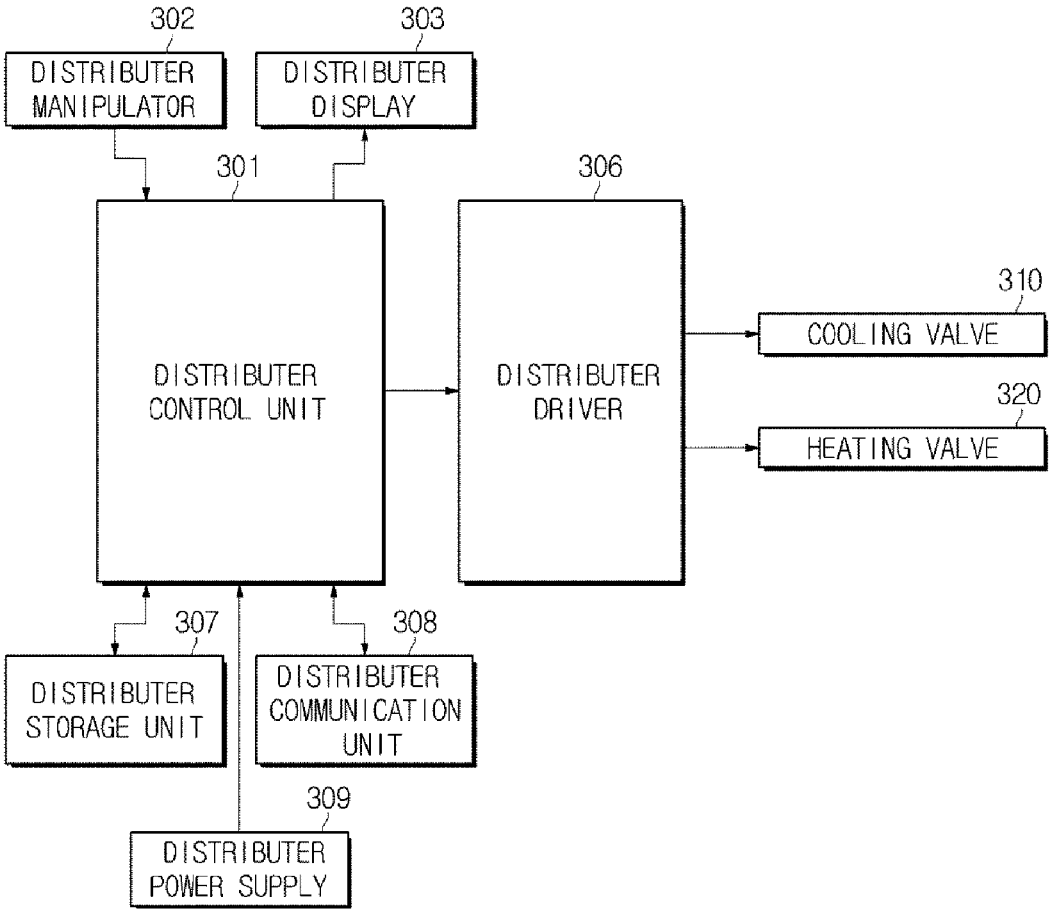
FIG. 6 illustrates exemplary flows of control signals in a distributer included in the air conditioner according to an embodiment.

FIG. 6 illustrates exemplary flows of control signals in the distributer included in the air conditioner according to an embodiment.

Referring to FIG. 6, the distributer 300 includes a distributer manipulator 302 to receive operation commands associated with the distributer 300 from the user or operator, a distributer display 303 to display operation information of the distributer 300, and a distributer driver 306 to drive the cooling valve 310 and heating valve 320 included in the distributer 300. The distributer 300 also includes a distributer storage unit 307 to store programs and data associated with operation of the distributer 300, a distributer communication unit 308 to communicate with the indoor units 200 and distributer 300 included in the air conditioner 1, a distributer power supply 309 to supply electric power to the included elements of the distributer 300, and a distributer control unit 301 to control operation of each included element of the distributer 300.

The distributer manipulator 302 may include button switches, membrane switches, or a touch panel to receive operation commands associated with the distributer 300, for example, a power input command. The distributer display 303 may include an LCD panel or an LED panel to display operation information of the distributer 300 such as a connection status of the distributer 300.

The distributer manipulator 302 or distributer display 303 may be omitted from the distributer 300.

The distributer driver 306 drives the cooling valve 310 and heating valve 320 in accordance with control signals from the distributer control unit 301. The distributer driver 306 generates drive current, and supplies the drive current to the cooling valve 310 and heating valve 320 in order to open or close the cooling valve 310 and heating valve 320.

The distributer storage unit 307 may include a non-volatile memory (not shown) such as a magnetic disc or a solid state drive to permanently store programs and data associated with operation of the distributer 300. Alternatively, the distributer storage unit 307 may include a volatile memory (not shown) such as a D-RAM or an S-RAM to temporarily store temporary data produced during operation of the distributer 300.

The distributer communication unit 308 may include a communication module (not shown) to execute communication with the indoor units 200 and distributer 300, using a communication system such as RS-485.

The distributer power supply 309 may include a rectifying circuit (not shown) to rectify external electric power, and a smoothing circuit (not shown) to remove ripples from the rectified electric power.

The distributer control unit 301 controls operation of each included element included in the distributer 300. For example, when the distributer control unit 301 receives a request to open the third cooling valve 310-3 (see, for example, FIG. 2) from the outdoor unit 100 via the distributer communication unit 308, the distributer control unit 301 controls the distributer communication unit 308, to transmit a valve opening request reception signal to the outdoor unit 100. The distributer control unit 301 also controls the distributer driver 306, to open the third cooling valve 310-3 (FIG. 2).

Figure 7A:
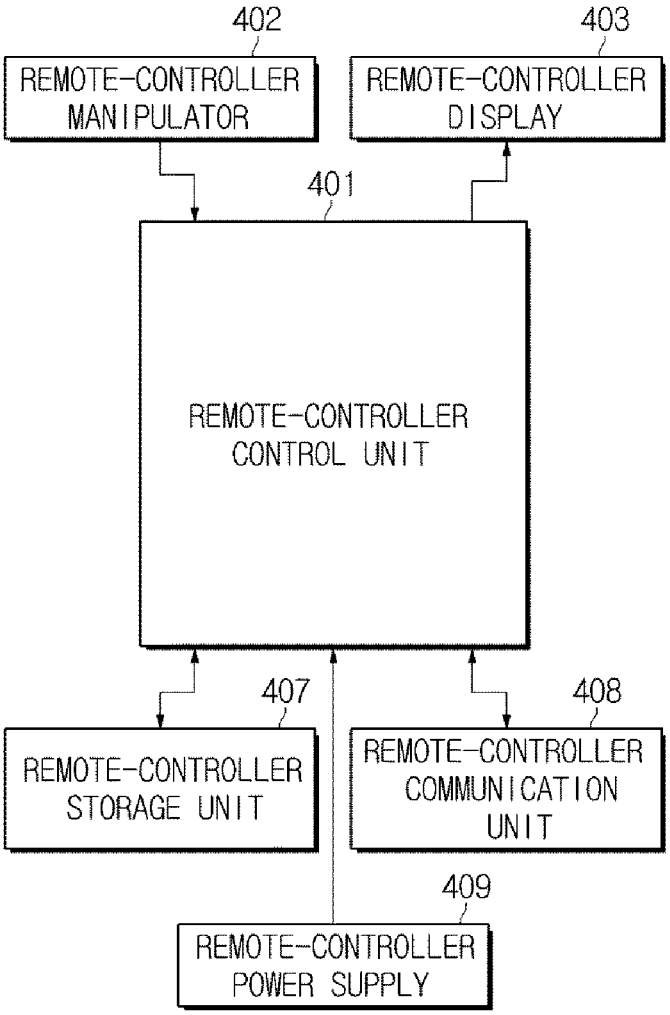
FIG. 7A illustrates exemplary flows of control signals in a remote controller included in the air conditioner according to an embodiment.
Figure 7B:
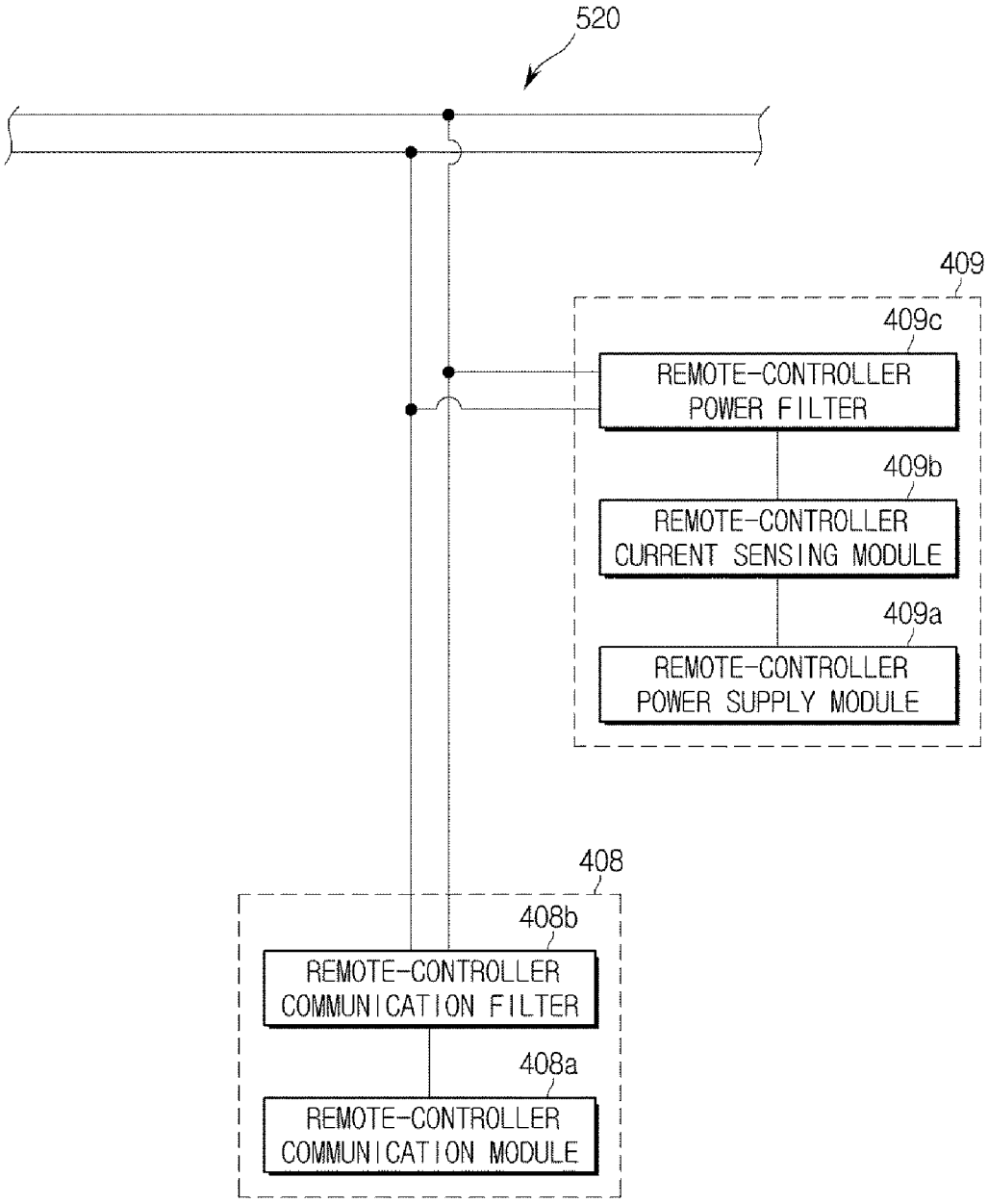
FIG. 7B illustrates an exemplary remote-controller power supply and a remote-controller communication unit, which are included in an air conditioner according to an embodiment.

FIG. 7A illustrates exemplary flows of control signals in the remote controller included in the air conditioner according to an embodiment. FIG. 7B illustrates exemplary a remote-controller power supply and a remote-controller communication unit, which are included in the air conditioner according to an embodiment.

Referring to FIGS. 7A and 7B, the remote controller 400 includes a remote-controller manipulator 402 to receive operation commands associated with the indoor units 200 from the user, a remote-controller display 403 to display operation information of the indoor units 200, and a remote-controller storage unit 407 to store programs and data associated with operation of the remote controller 400. The remote controller 400 includes a remote-controller communication unit 408 to communicate with the indoor units 200 and another remote controller, a remote-controller power supply 409 to supply electric power to the included elements of the remote controller 400, and a remote-controller control unit 401 to control operation of each included element of the remote controller 400.

The indoor-unit manipulator 402 may include button switches, membrane switches, or a touch panel to receive operation commands associated with the indoor units 200. The remote-controller display 403 may include an LCD panel or an LED panel to display operation information of the indoor units 200.

The remote-controller storage unit 407 may include a non-volatile memory (not shown) such as a magnetic disc or a solid state drive to permanently store programs and data associated with operation of the remote controller 400. Alternatively, the remote-controller storage unit 407 may include a volatile memory (not shown) such as a D-RAM or an S-RAM to temporarily store temporary data produced during operation of the remote controller 400.

The remote-controller communication unit 408 may include a remote-controller communication module 408*a* to execute communication with the indoor units 200 via the second communication line 520, and a remote-controller communication filter 408*b* to allow high-frequency communication signals received via the second communication line 520 to pass therethrough while preventing DC power received via the second communication line 520 from passing therethrough. The second communication line 520 transmits DC power and high-frequency communication signals. The remote-controller communication filter 408*b* allows high-frequency communication signals transmitted via the second communication line 520 to pass therethrough while preventing DC power transmitted via the second communication line 520 from passing therethrough. The remote-controller communication filter 408*b* may include a high-pass filter to allow high-frequency signals to pass therethrough while preventing low-frequency signals from passing therethrough.

The remote-controller power supply 409 includes a remote-controller power supply module 409*a* to supply electric power to the remote controller 400, a remote-controller voltage sensing module 409*b* to sense a voltage supplied to the remote-controller power supply 409 via the second communication line 520, and a remote-controller power filter 409*c* to block high-frequency communication signals received via the second communication line 520. Since the second communication line 520 transmits DC power and high-frequency communication signals, the remote-controller power filter 409*c* allows DC power transmitted via the second communication line 520 to pass therethrough while preventing high-frequency communication signals transmitted via the second communication line 520 from passing therethrough. In this regard, the remote-controller communication filter 409*c* may include a low-pass filter to allow low-frequency signals to pass therethrough while preventing high-frequency signals from passing therethrough.

The remote-controller control unit 401 may control operation of each element included in the remote controller 400. For example, when the user changes a target temperature by manipulating the remote-controller manipulator 402, the remote-controller control unit 401 controls the remote-controller display 403 to display the changed target temperature, and controls the remote-controller communication unit 408 to transmit information of the changed target temperature to the indoor units 200. The remote-controller control unit 401 may include a single general processor to execute all arithmetic operations associated with operation of the remote controller 400, or a processor to execute specialized arithmetic operations, for example, a communication process to only execute arithmetic operations associated with communications, or a control processor to only execute arithmetic operations associated with control operations.

Exemplary configurations of the air conditioner associated with flow of refrigerant and flows of signals are disclosed.

An exemplary supply of electric power to the remote controller by one of the indoor units is disclosed.

As described with reference to FIG. 3, the remote controller 400 does not directly receive electric power from an external power source, but receives electric power from one of the indoor units 200 via the second communication line 520. The indoor units 200 may be spatially spaced apart from one another by a considerable distance. For example, when one indoor unit 200 is disposed on each floor in a 10-story building with each floor being approximately 2.5 m in height, there is a distance of at least approximately 25 m between the 10th indoor unit 200-10 disposed at the 10th story and the first indoor unit 200-1 disposed at the first story. In this case, when the remote controller 400 is disposed at the first story together with the first indoor unit 200-1, and the 10th indoor unit 200-10 disposed at the 10th story supplies electric power to the remote controller 400, the electric power supplied from the 10th indoor unit 200-10 at the 10th story may exhibit voltage drop while reaching the remote controller 400 at the first story, due to parasitic resistance generated in the second communication line 520. As a result, it may be difficult to supply sufficient voltage to the remote controller 400.

According to an exemplary embodiment the air conditioner 1 may be controlled to select the indoor unit, which is capable of supplying electric power with sufficient voltage to the remote controller 400, in order to prevent the remote controller 400 from receiving electric power with insufficient voltage.

Figure 8A:
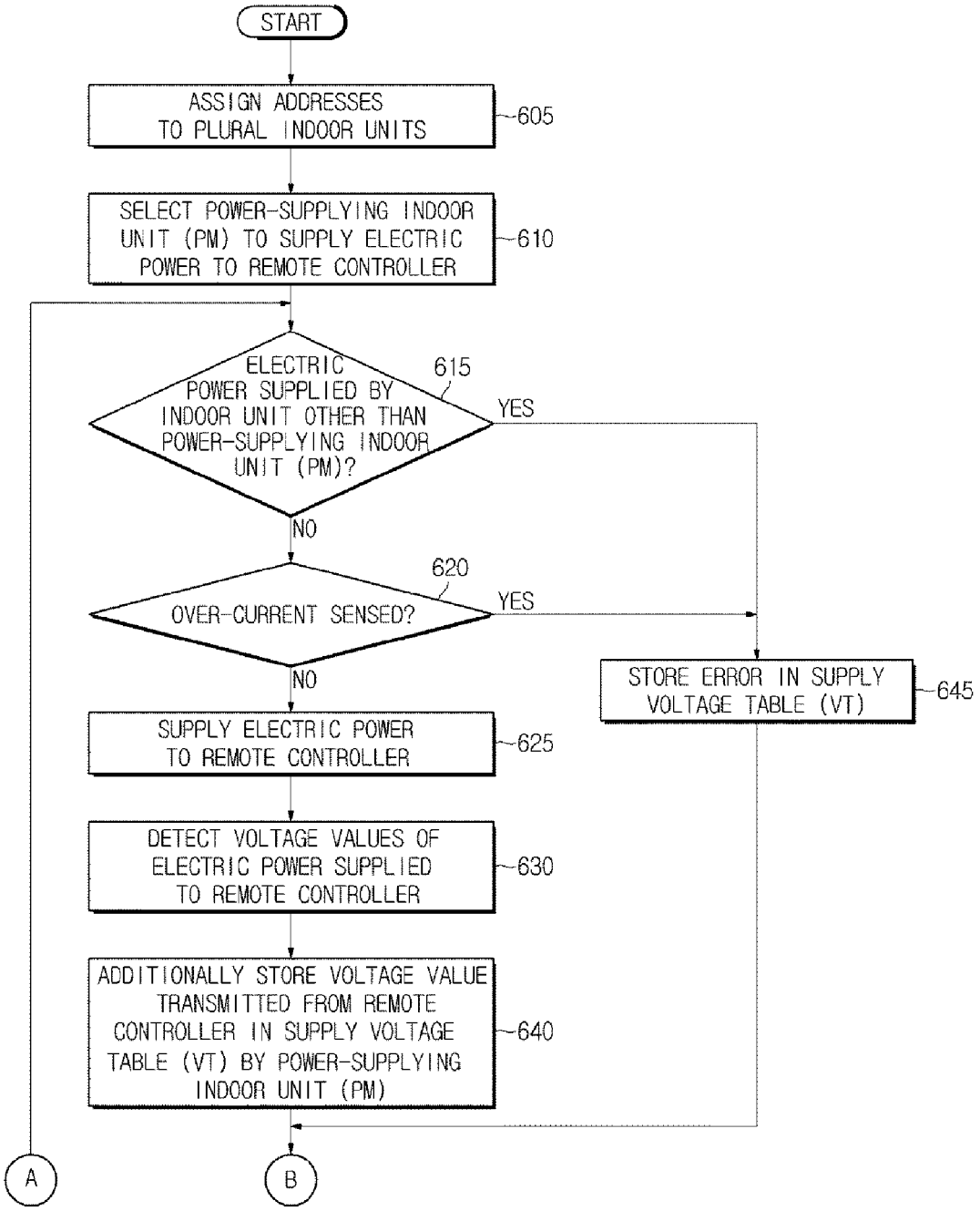
FIGS. 8A and 8B illustrate an exemplary method for controlling the air conditioner according to an embodiment to automatically select one indoor unit to supply electric power to the remote controller.
Figure 8B:
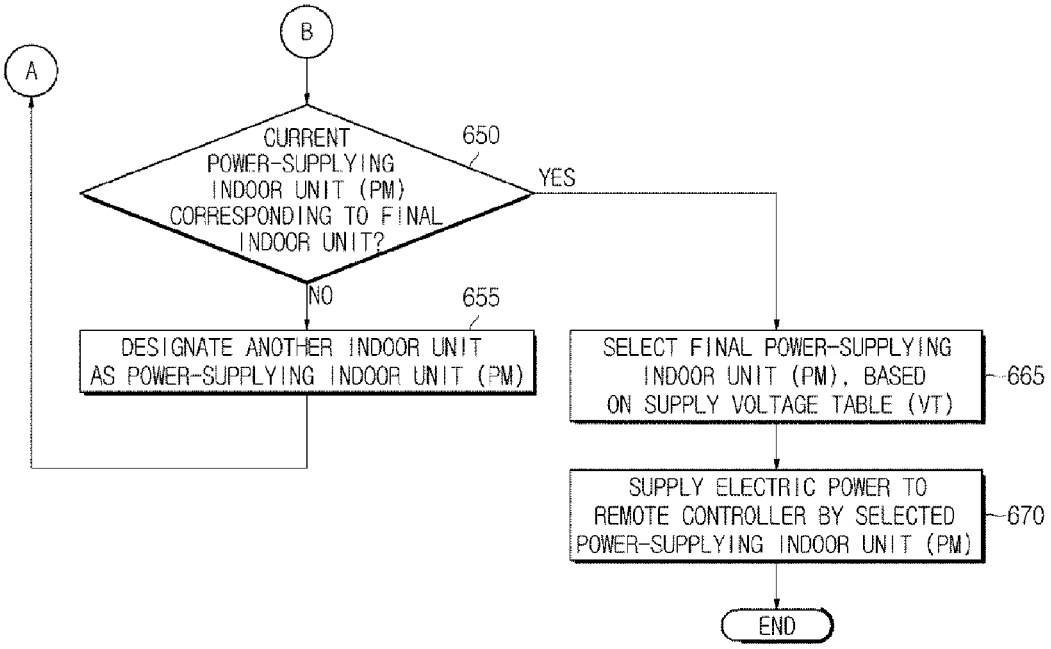
Figure 9A:
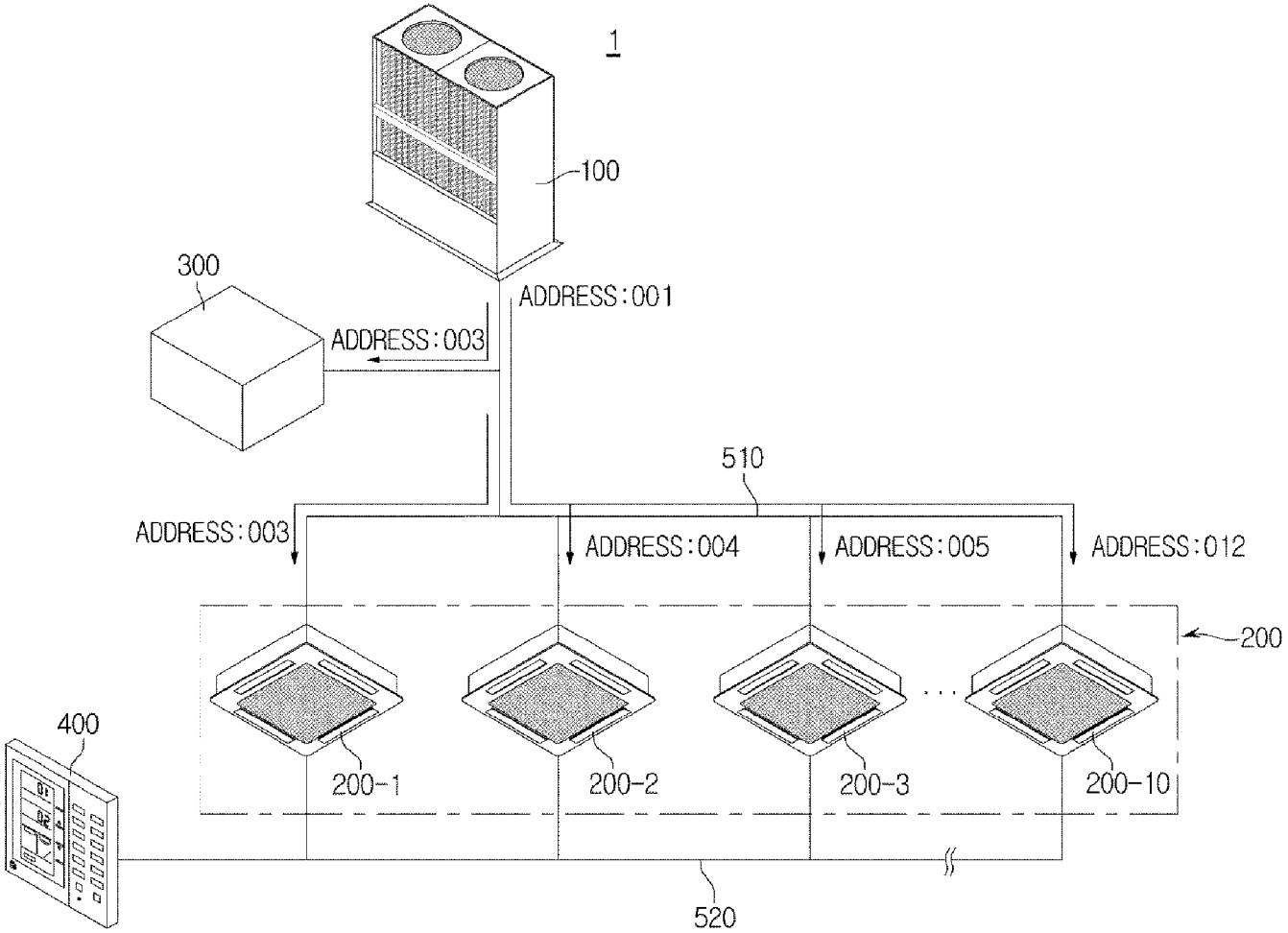
Figure 9B:
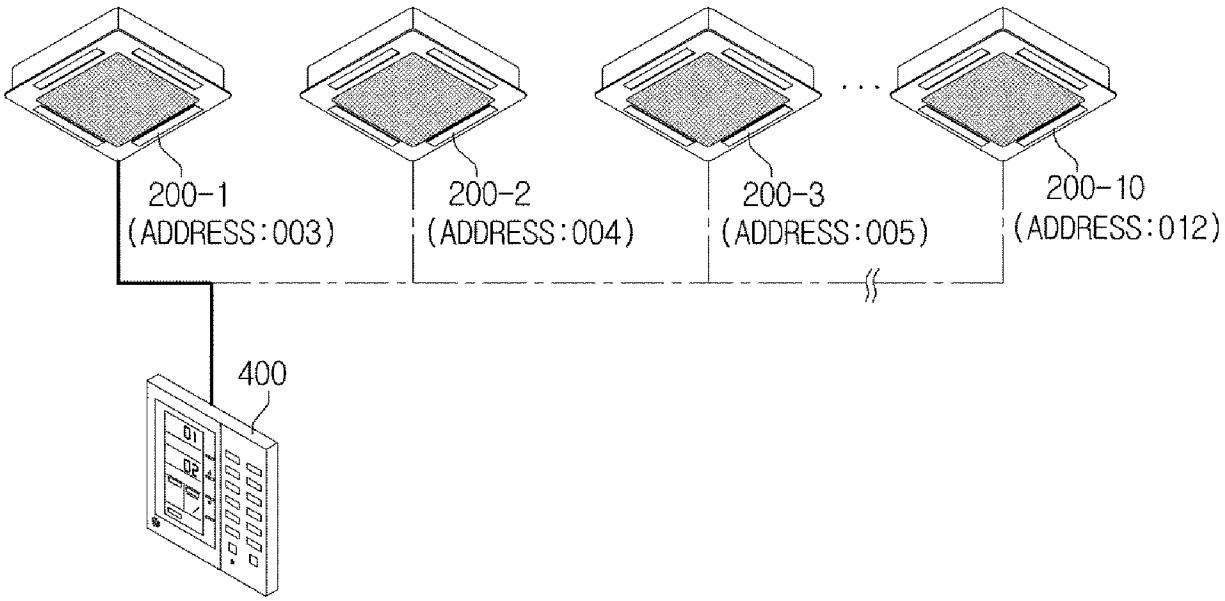
Figure 9C:
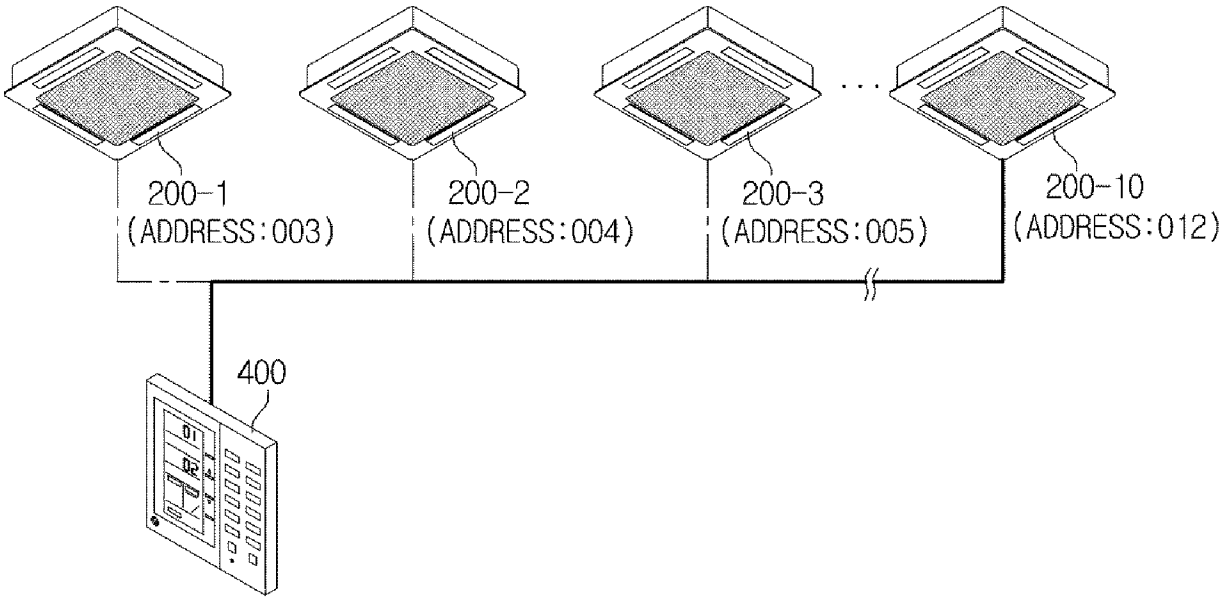

FIGS. 8A and 8B are flowcharts illustrating an exemplary method for controlling the air conditioner according to an embodiment to automatically select one indoor unit to supply electric power to the remote controller. FIGS. 9A to 9C are views illustrating an exemplary procedure of controlling the air conditioner according to an embodiment to select one indoor unit to supply electric power to the remote controller.

Referring to FIG. 3, FIGS. 8A and 8B, and FIGS. 9A to 9C, when electric power is applied, e.g., initially applied to the air conditioner 1, the air conditioner 1 assigns addresses for communications to respective indoor units 200 (605). When electric power is initially applied, the outdoor unit 100 searches the first communication line 510 for the indoor units 200 and distributer 300, and assigns addresses for communications through the first communication line 510 to the outdoor unit 100 itself and the searched indoor units 200 and distributer 300. For example, when it is assumed that the air conditioner 1 includes 10 indoor units, as illustrated in FIG. 9A, the outdoor unit 100 may assign addresses to the outdoor unit 100, indoor units 200, and distributer 300 included in the air conditioner 1 in such a manner that an address "001" is assigned to the outdoor unit 100, an address "002" is assigned to the distributer 300, an address "003" is assigned to the first indoor unit 200-1, an address "004" is assigned to the second indoor unit 200-2, and an address "012" is assigned to the last indoor unit, namely, the 10th indoor unit 200-10.

The air conditioner 1 selects, from among the indoor units 200, one indoor unit to supply electric power to the remote controller 400, namely, the power-supplying indoor unit PM (610). For example, the air conditioner 1 may select the power-supplying indoor unit PM, based on the addresses assigned to the indoor units 200 by the outdoor unit 100. That is, the air conditioner 1 may select the first indoor unit 200-1 assigned a lowest one of the addresses assigned to the indoor units 200, namely, the address "003", as an initial power-supplying indoor unit PM.

The air conditioner 1 determines whether one indoor unit other than the power-supplying indoor unit PM supplies electric power to the remote controller 400 (615). When the power-supplying indoor unit PM and another indoor unit are connected to the second communication line 520 at opposite polarities, for example, when the power supply terminal of the power-supplying indoor unit PM and the ground terminal of the other indoor unit are connected to the first communication wire of the second communication line, and the ground terminal of the power-supplying indoor unit PM and the power supply terminal of the other indoor unit are connected to the second communication wire of the second communication line, and electric power is supplied through the second communication line by the other indoor unit and the power-supplying indoor unit PM, the power-supplying indoor unit PM and the other indoor unit are short-circuited. The power-supplying indoor unit PM and the other indoor unit may be damaged. When the indoor-unit current sensing module 209*b* (see, for example, FIG. 5B) of the power-supplying indoor unit PM senses current under the condition that the indoor-unit power supply module 209*a* (see, for example, FIG. 5B) of the power-supplying indoor unit PM does not supply electric power to the remote controller 400, the air conditioner 1 may determine that the other indoor unit supplies electric power to the remote controller 400 via the second communication line 520.

When it is determined that the other indoor unit does not supply electric power to the remote controller 400 ("NO" in operation 615), the air conditioner 1 determines whether over-current is sensed in the power-supplying indoor unit PM when the power-supplying indoor unit PM supplies electric power to the remote controller (620). When the power-supplying indoor unit PM supplies electric power to the remote controller 400 for a short time, and the magnitude of the current sensed by the indoor-unit current sensing module 209*b* (FIG. 5B) of the power-supplying indoor unit PM is equal to or higher than a reference current magnitude, the air conditioner 1 may determine that over-current has been generated.

When it is determined that over-current has not been generated ("NO" in operation 620), the air conditioner 1 controls the power-supplying indoor unit PM to supply electric power to the remote controller 400 (625). The indoor-unit power supply module 209*a* (see, for example, FIG. 5B) supplies electric power to the remote controller 400 via the second communication line 520.

The air conditioner 1 detects a voltage supplied to the remote controller 400. In detail, when electric power is supplied via the second communication line 520, the remote-controller voltage sensing module 409*b* (FIG. 7B) of the remote controller 400 may sense a voltage value of the electric power supplied to the remote controller 400.

The air conditioner 1 stores the sensed voltage value in a supply voltage table VT (640). The remote controller 400 transmits the voltage value sensed by the remote-controller voltage sensing module 409*b* (FIG. 7B) to the power-supplying indoor unit PM via the second communication line 520. The power-supplying indoor unit PM may store the address of the power-supplying indoor unit PM and the voltage value transmitted thereto in the supply voltage table VT as shown in FIG. 9D.

When one indoor unit other than the power-supplying indoor unit PM supplies electric power to the remote controller 400 ("YES" in operation 615), or when over-current is sensed ("YES" in operation 620), the air conditioner 1 stores an error in the supply-voltage table VT (645). That is, when another indoor unit other than the power-supplying indoor unit PM supplies electric power via the second communication line 520, or when over-current is sensed during power supply of the power-supplying indoor unit PM, the power-supplying indoor unit PM stores an error in the supply-voltage table VT without supplying electric power via the second communication line 520.

When a voltage value of electric power or an error is stored in the supply-voltage table VT, the air conditioner 1 determines whether the current power-supplying indoor unit PM is a final one of the indoor units (650). When the number of voltage values stored in the supply voltage table VT or the number of errors stored in the power supply table VT is identical to the number of the indoor units 200, or when the address of the current power-supplying indoor unit PM corresponds to a final one of the addresses assigned to the indoor units, namely, the address "012", the air conditioner 1 may determined that the current power-supplying indoor unit PM is the final indoor unit.

When the current power-supplying indoor unit PM is not the final indoor unit ("NO" in operation 650), the air conditioner 1 selects another indoor unit as the power-supplying indoor unit PM (655). The air conditioner 1 may designate, as a new power-supplying indoor unit, another indoor unit, which is assigned a next one of the addresses assigned by the outdoor unit 100. When a new power-supplying indoor unit is designated, the previous power-supplying indoor unit may transmit a supply voltage table VT to the new power-supplying indoor unit.

The air conditioner 1 repeats procedures of determining whether another indoor unit as a news power-supplying indoor unit PM supplies electric power, determining whether over-current is sensed, and supplying electric power via the second communication line 520, until the final indoor unit supplies electric power.

When the power-supplying indoor unit PM is the final indoor unit ("YES" in operation 650), the air conditioner 1 selects the power-supplying indoor unit PM, based on the supply voltage table VT (665). The air conditioner 1 selects, as the power-supplying indoor unit PM, the indoor unit, which supplies a highest one of the voltage values written in the supply voltage table VT. For example, when data as illustrated in FIG. 9D is stored in the supply voltage table VT, the air conditioner 1 may select the first indoor unit 200-1 assigned an address "003" as the final power-supplying indoor unit PM.

When there are two or more remote controllers, it may be possible to select, as the power-supplying indoor unit PM, the indoor unit, which exhibits a highest arithmetic average of voltage values transmitted by the remote controllers or a highest root mean square of the voltage values transmitted by the remote controllers.

The air conditioner 1 controls the indoor unit finally selected as the power-supplying indoor unit PM to supply electric power to the remote controller 400 (670). In other words, the indoor unit 200, which supplies a highest voltage, among the indoor units 200, supplies electric power to the remote controller 400.

A method of automatically selecting the power-supplying indoor unit PM to supply electric power to the remote controller 400 has been described. However, the air conditioner 1 may not automatically select the power-supplying indoor unit PM due to errors, e.g., unexpected errors. For example, when electrical power is constantly supplied via the second communication line 520 due to malfunction of two or more indoor units, the supply voltage table VT has completely been stored with errors. In this case, the air conditioner 1 may not automatically select the power-supplying indoor unit PM.

A user may select the power-supplying indoor unit PM.

Figure 10:
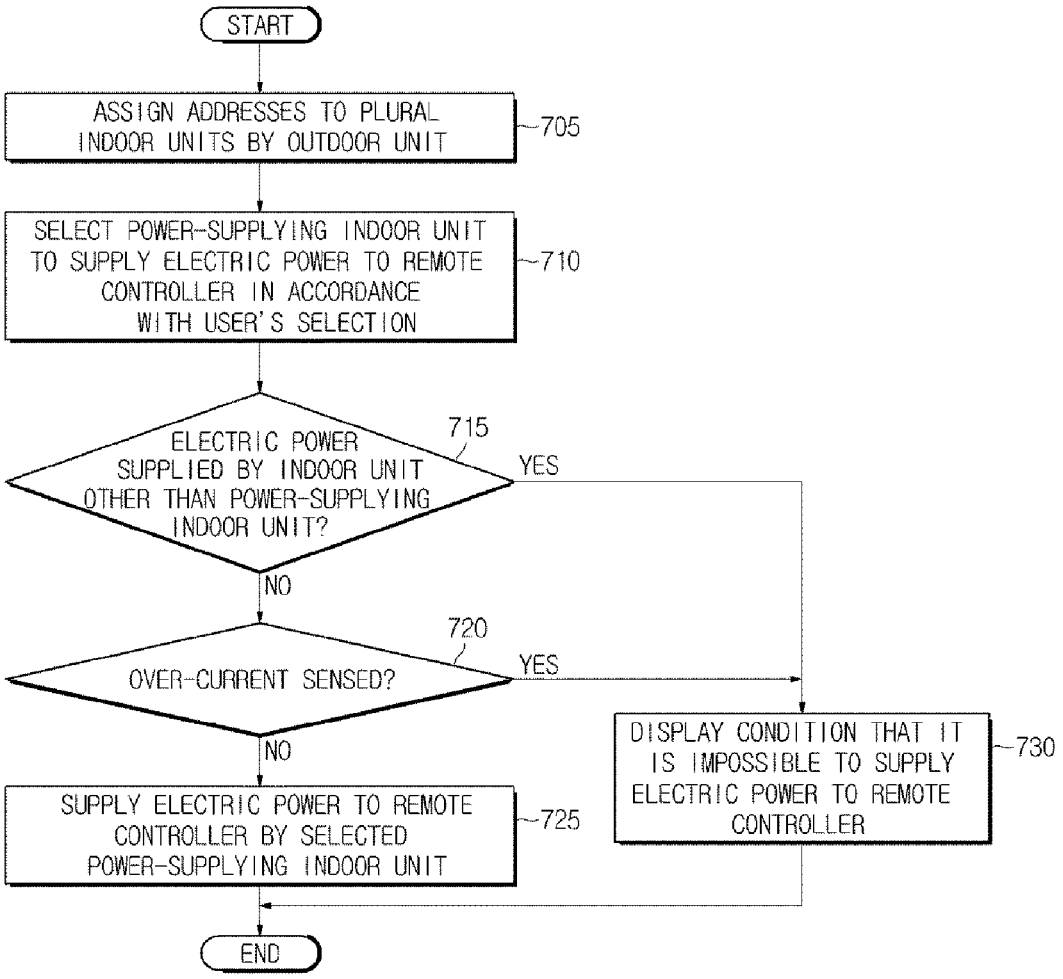
FIG. 10 illustrates an exemplary method for controlling the air conditioner to select one indoor unit to supply electric power to the remote controller in accordance with a user's selection.

FIG. 10 is a flowchart illustrating an exemplary method for controlling the air conditioner to select one indoor unit to supply electric power to the remote controller in accordance with a user's selection.

Referring to FIGS. 3 and 10, when electric power is assigned, e.g., initially applied to the air conditioner 1, the air conditioner 1 assigns addresses for communications to respective indoor units 200 (705). When electric power is initially applied, the outdoor unit 100 searches the first communication line 510 for the indoor units 200 and distributer 300, and then assigns addresses for communications through the first communication line 510 to the outdoor unit 100 itself and the searched indoor units 200 and distributer 300.

The air conditioner 1 selects, from among the indoor units 200, one indoor unit to supply electric power to the remote controller 400, namely, the power-supplying indoor unit PM, in accordance with a user's selection (710). For example, the user may select one of the indoor units 200 as the power-supplying indoor unit PM by manipulating the outdoor unit 100.

The air conditioner 1 determines whether one indoor unit other than the power-supplying indoor unit PM supplies electric power to the remote controller 400 (715). In detail, when the indoor-unit current sensing module 209*b* (see, for example, FIG. 5B) of the power-supplying indoor unit PM senses current under the condition that the indoor-unit power supply module 209*a* (FIG. 5B) of the power-supplying indoor unit PM does not supply electric power to the remote controller 400, the air conditioner 1 may determined that the other indoor unit supplies electric power to the remote controller 400 via the second communication line 520.

When it is determined that the other indoor unit does not supply electric power to the remote controller 400 ("NO" in operation 715), the air conditioner 1 determines whether over-current is sensed in the power-supplying indoor unit PM when the power-supplying indoor unit PM supplies electric power to the remote controller (720). When the power-supplying indoor unit PM supplies electric power to the remote controller 400 for a short time, and the magnitude of the current sensed by the indoor-unit current sensing module 209*b* (FIG. 5B) of the power-supplying indoor unit PM is equal to or higher than a reference current magnitude, the air conditioner 1 may determine that over-current has been generated.

When it is determined that over-current has not been generated ("NO" in operation 720), the air conditioner 1 controls the indoor unit selected as the power-supplying indoor unit PM by the user to supply electric power to the remote controller 400 (725). In order words, the indoor unit selected by the user from among the indoor units 200 supplies electric power to the remote controller 400.

When one indoor unit other than the power-supplying indoor unit PM supplies electric power to the remote controller 400 ("YES" in operation 715), or when over-current is sensed ("YES" in operation 720), the air conditioner 1 displays a condition that it is impossible to supply electric power to the remote controller 400, to inform the user of the condition (730). For example, the outdoor unit 100 may display erroneous setting of the power-supplying indoor unit through the outdoor-unit display 103 (FIG. 4) while displaying a recommendation to select another indoor unit as the power-supplying indoor unit PM.

In accordance with an aspect of the present invention, it may be possible to supply electric power with a sufficiently high voltage to a remote controller by supplying electric power to the remote controller by one indoor unit exhibiting a highest voltage value of electric power to be supplied to the remote controller, as compared to other indoor units.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An air conditioner comprising:

at least one outdoor unit configured to execute a heat exchange operation for a heat exchange between outdoor air and a refrigerant;

a plurality of indoor units configured to a execute heat exchange operation for the heat exchange between indoor air and the refrigerant; and at least one remote controller configured to receive a user input for the plurality of indoor units and communicate with the plurality of indoor units through a communication line, wherein at least one indoor unit among the plurality of indoor units is selected based on voltage values of electric power supplied to the at least one remote controller from the plurality of indoor units, and the at least one remote controller is supplied with the electric power from the at least one indoor unit through the communication line.

2. The air conditioner according to claim 1, wherein DC electric power is supplied from the at least one indoor unit to the at least one remote controller through the communication line while high-frequency communication signals being transmitted through the communication line.

3. The air conditioner according to claim 2, wherein the at least one remote controller comprises a remote-controller power supply module to receive the DC power supplied from the at least one indoor unit via the communication line, and a remote-controller power filter to block the high-frequency communication signals.

4. The air conditioner according to claim 2, wherein each of the plurality of indoor units comprises an indoor-unit power supply module to supply the DC power to the at least one remote controller via the communication line, and an indoor-unit power filter to block the high-frequency communication signals.

5. The air conditioner according to claim 1, wherein, when the plurality of indoor units supply electric power to the at least one remote controller in accordance with a predetermined sequence, the at least one remote controller detects voltage values of the electric power supplied from the plurality of indoor units.

6. The air conditioner according to claim 5, wherein the plurality of indoor units supply electric power to the at least one remote controller in accordance with a predetermined sequence based on addresses of the plurality of indoor units.

7. The air conditioner according to claim 5, wherein each of the plurality of indoor units determines whether another one of the plurality of indoor unit supplies electric power to the at least one remote controller, and supplies electric power to the at least one remote controller when it is determined that there is no indoor unit supplying electric power to the at least one remote controller.

8. The air conditioner according to claim 5, wherein each of the plurality of indoor units determines whether over-current flows through the communication line, and supplies electric power to the at least one remote controller when it is determined that no over-current flows through the communication line.

9. The air conditioner according to claim 5, wherein the at least one indoor unit is selected from among the plurality of indoor units, based on the voltage values detected by the at least one remote controller.

10. The air conditioner according to claim 9, wherein, when the at least one remote controller comprises a single remote controller, the at least one indoor unit, which supplies electric power with a highest voltage value detected by the single remote controller, is selected from among the plurality of indoor units.

11. The air conditioner according to claim 9, wherein, when the at least one remote controller comprises at least two remote controllers, the at least one indoor unit, which supplies electric power with a highest average of voltage values detected by the at least two remote controllers, is selected from among the plurality of indoor units.

12. A method for controlling an air conditioner including at least one outdoor unit, a plurality of indoor units, and at least one remote controller, comprising:

measuring voltage values of electric power supplied from the plural indoor units;

selecting at least one indoor unit among the plurality of indoor units based on the measured voltage values; and supplying electric power to the at least one remote controller from the at least one indoor unit via a communication line, through which the plurality of indoor units and the at least one remote controller communicate each other.

13. The method according to claim 12, wherein DC electric power is supplied from the at least one indoor unit to the at least one remote controller through the communication line while high-frequency communication signals being transmitted through the communication line.

14. The method according to claim 12, further comprising supplying the electric power to the at least one remote controller from the plurality of indoor units in accordance with a predetermined sequence based on addresses of the plurality of indoor units.

15. The method according to claim 14, further comprising determining whether one of the plurality of indoor units supplies electric power to the at least one remote controller, and supplying electric power to the at least one remote controller when it is determined that there is no indoor unit supplying electric power to the at least one remote controller.

16. The method according to claim 14, further comprising determining whether over-current flows through the communication line, and supplying electric power to the at least one remote controller when it is determined that no over-current flows through the communication line.

17. The method according to claim 12, wherein, when the at least one remote controller comprises a single remote controller, the selecting of the at least one indoor unit comprises selecting the at least one indoor unit, which supplies electric power with a highest voltage value detected by the single remote controller, as the power-supplying indoor unit.

18. The method according to claim 12, wherein, when the at least one remote controller comprises at least two remote controllers, the selecting of the at least one indoor unit comprises selecting the at least one indoor unit, which supplies electric power with a highest average of voltage values detected by the at least two remote controllers, as the power-supplying indoor unit.

19. A method for controlling a device including at least one unit in a first location, a plurality of units in a second location, and at least one remote controller, comprising:

supplying power to the at least one remote controller from at least some of the plurality of units in the second location;

detecting a voltage value of the power respectively supplied from the at least some of each of the plurality of units in the second location;

selecting a power-supplying unit in the second location to supply power to the at least one remote controller, based on the detected voltage values; and supplying the power to at least one remote controller from the selected power-supplying unit via a communication line, through which the plurality of indoor units and the at least one remote controller communicate each other.

* * * * *